US008551378B2

(12) United States Patent
Velev et al.

(10) Patent No.: US 8,551,378 B2
(45) Date of Patent: Oct. 8, 2013

(54) NANOSPINNING OF POLYMER FIBERS FROM SHEARED SOLUTIONS

(75) Inventors: Orlin D. Velev, Cary, NC (US); Stoyan Smoukov, Chicago, IL (US); Manuel Marquez, Midlothian, VA (US)

(73) Assignee: North Carolina State University, Raleigh, NC (US)

( * ) Notice: Subject to any disclaimer, the term of this patent is extended or adjusted under 35 U.S.C. 154(b) by 591 days.

(21) Appl. No.: 12/730,644

(22) Filed: Mar. 24, 2010

(65) Prior Publication Data

US 2010/0247908 A1 Sep. 30, 2010

Related U.S. Application Data

(60) Provisional application No. 61/162,925, filed on Mar. 24, 2009.

(51) Int. Cl.

| | |
|---|---|
| ***C08F 6/00*** | (2006.01) |
| ***C08J 3/11*** | (2006.01) |
| ***D01D 5/18*** | (2006.01) |
| ***D01D 5/40*** | (2006.01) |

(52) U.S. Cl.
USPC ..... 264/211.1; 528/502 F

(58) Field of Classification Search
USPC ..... 264/211.1; 528/502 F
See application file for complete search history.

(56) References Cited

U.S. PATENT DOCUMENTS

| | | | | |
|---|---|---|---|---|
| 2,988,782 | A | 6/1961 | Guandique et al. | 18/48 |
| 3,743,272 | A | 7/1973 | Nowotny et al. | 264/69 |
| 3,902,957 | A | 9/1975 | Kozlowski | 162/157 |
| 3,995,001 | A | 11/1976 | Vroomans et al. | 264/8 |
| 3,997,648 | A | 12/1976 | Davis et al. | 264/140 |
| 4,013,751 | A | 3/1977 | Davis et al. | 264/140 |
| 4,020,266 | A | 4/1977 | Frank et al. | 528/498 |
| 4,048,429 | A | 9/1977 | van den Berg et al. | 528/497 |
| 4,134,931 | A | 1/1979 | Hayes, Jr. et al. | 260/897 |
| 4,198,461 | A | 4/1980 | Keller et al. | 428/288 |
| 4,224,259 | A | 9/1980 | Sander et al. | 264/11 |
| 4,274,917 | A | 6/1981 | Murphy et al. | 162/146 |
| 4,511,623 | A | 4/1985 | Yoon et al. | 428/359 |
| 5,460,498 | A | 10/1995 | Steel et al. | 425/8 |
| 7,323,540 | B2 | 1/2008 | Velev et al. | 528/502 |
| 2010/0247908 | A1 | 9/2010 | Velev et al. | |
| 2011/0266213 | A1 | 11/2011 | Jo et al. | |

FOREIGN PATENT DOCUMENTS

JP 2004285538 A 10/2004

OTHER PUBLICATIONS

Alargova et al., *Adv. Mater.*, 2004, 16, 1653-1657.
Alargova et al., *Langmuir*, 2006, 22, 765-774.

*Primary Examiner* — Leo B Tentoni
(74) *Attorney, Agent, or Firm* — The Eclipse Group LLP; David P. Gloekler; Nathan P. Letts

(57) ABSTRACT

Nanofibers are fabricated by introducing a polymer solution into a dispersion medium and shearing the dispersion medium. Droplets of the polymer solution are spun into elongated fibers that are insoluble in the dispersion medium.

36 Claims, 8 Drawing Sheets

NANOSPINNING OF POLYMER FIBERS FROM SHEARED SOLUTIONS

RELATED APPLICATIONS

This application claims the benefit of U.S. Provisional Patent Application Ser. No. 61/162,925, filed Mar. 24, 2009, titled "NANOSPINNING OF POLYMER FIBERS FROM SHEARED SOLUTIONS", the content of which is incorporated by reference herein in its entirety.

TECHNICAL FIELD

The present invention relates generally to nanofibers and techniques for making them. More specifically, the invention relates to nanofibers formed by a process where a polymer solution is sheared in viscous liquid.

BACKGROUND

Nanofibers have been shown to greatly improve the mechanical efficiency of both liquid and aerosol filtration, with only a modest increase in the pressure drop. The high surface area and fine pore size of nonwoven fabrics makes them ideal for selective permeability membranes. Nanofibers have been utilized in protective textiles as breathable barriers to liquid penetration, in nanoparticle filtration, heavy metal decontamination, and in fabrication of protein affinity membranes. Biocompatible and biodegradable nanofibers are considered essential for the future development of scaffolds in tissue engineering, as resorbable membranes that prevent post-surgery adhesions, as well as in the delivery of a number of agents, including antibiotics, DNA, or proteins.

The addition of inorganic particles to polymer fibers gives them additional functionality and often improves their mechanical properties. Polystyrene/clay and PE/carbon nanotube composite fibers have shown enhanced strength compared to the pure polymer fibers. Composite fibers with silver nanoparticles are studied intensely due to their antibacterial properties. Biocatalytic fibers are made by the inclusion of active enzymes in the fibers, or even by the incorporation of whole viruses, which can maintain their ability to infect bacteria. Embedding such composite fibers into protective clothing would impart additional functionalities besides superior softness and thermal insulation currently provided by microfibers.

Flexible electronics are another emerging area where nanofibers offer useful properties in sensing, miniaturization and integration with existing textiles. Sensing of chemical and optical signals has recently been demonstrated. Nanofibers can form one-dimensional heterojunctions, be assembled into field-effect transistors, and emit light by electroluminescence. Nanofibers can also make possible enhanced charge separation in photovoltaics. In all the above applications, high volume and low production cost are either essential for commercialization or could significantly benefit related applications.

Five general methods for the production of fibers with nanometer or single-micron diameters exist: drawing, phase separation, electrospinning, template synthesis and self-assembly. So far only three major technologies have the potential to produce these fibers on a commercial scale: melt blowing, splitting/dissolving of bicomponent fibers, and electrospinning. The first two techniques are based on mechanical drawing of melts and are well-established in high-volume manufacturing. In melt blowing polymers are extruded from dies and stretched to smaller diameters by heated, high velocity air streams. Bicomponent spinning involves extrusion of two immiscible polymers and two-step processing: (1) melt spinning the two polymer melts through a die with a "segmented pie" or "islands-in-the-sea" configuration, followed by solidification and (2) release of small filaments by mechanically breaking the fiber or by dissolving one of the components. For melt-processable polymers, this is the most commercially viable method due to its relatively high productivity. In individual cases both techniques have produced submicron diameter fibers (500 nm by melt blowing and 300 nm from bicomponent spinning), although commercial operations of melt blown fiber production are usually restricted to fibers thicker than 2 μm. The biggest disadvantage of these techniques is that they are limited to melt-processable polymers.

Many polymers of commercial interest, however, including acrylics and especially polymers that are biocompatible and biodegradable, are only processed from their solution. So far no commercial solution spinning method has been developed for creating nanofibers from such polymers. The two main types of solution spinning, dry-spinning and wet spinning, like melt spinning, also involve extrusion of the polymer through an orifice. In dry-spinning the polymer is then drawn through air at elevated temperature while the solvent evaporates. In wet-spinning the fiber is drawn in a coagulation bath. Wet spinning is the highest-volume technique for fiber production from solutions as it imposes few limitations on the polymer solvent, is often carried out at room temperature, and does not require handling of volatile solvents. Challenges exist for the production of smaller diameter fibers with wet-spinning. First, high pressures are needed for extrusion through smaller nozzles. Second, clogging of the small nozzles may occur, especially due to aggregation of particulate additives used to make composite fibers. Both of these limitations restrict the minimum wet-spun fiber diameter to 10-20 μm, yet bulk production of finer fibers from solution-processed polymers is highly desirable.

Electrospinning differs from melt or dry spinning by the fact that electrostatic rather than mechanical forces are used to draw the fibers. Among the three techniques mentioned, electrospinning can produce the smallest fibers (20-2000 nm in diameter), and is the only one that can produce sub-micron fibers from most polymers. Its recent popularity is partially due to numerous potential applications in protective barrier applications, tissue engineering and flexible electronics. However, its low production rate is a major disadvantage of this technique. New efforts to increase its throughput have included the use of multiple nozzles in parallel (multi jet electrospinning) though so far only technology provided by Elmarco, Inc., initiating fibers without nozzles from a thin film of polymer solution on a rotating drum, has the potential for commercial applications. According to the company literature, one of their commercial electrospinning units has a nanofiber production capacity of ~0.4 g/min (~0.1 g/min per spinning drum). For the wide commercialization of nanofibers there is an urgent need for a method capable of several orders of magnitude higher productivity.

Accordingly, an ongoing need remains for improved techniques for fabricating nano-scale diameter polymer fibers.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a method for fabricating polymer nanofibers includes introducing a polymer solution into a dispersion medium and shearing the dispersion medium. Droplets of the polymer solution are spun into elongated fibers that are insoluble in the dispersion medium.

A wide variety of polymers may be utilized as a starting material, examples of which are given below.

According to another implementation, a polymer nanofiber material is provided. In some implementations, the polymer nanofiber may be fabricated by introducing a polymer solution into a dispersion medium and shearing the dispersion medium. The polymer nanofiber material may be incorporated into various products, structures or devices, and/or be utilized for various functions or purposes.

According to another implementation, an apparatus for fabricating polymer nanofibers is provided. In various implementations, the apparatus may include a structure or device for containing a dispersion medium, a structure or device for adding polymer solution to the dispersion medium, a structure or device for shearing the dispersion medium, a structure or device for controlling the amount of shear stress or force applied, and various combinations of two or more of the foregoing structures or devices.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
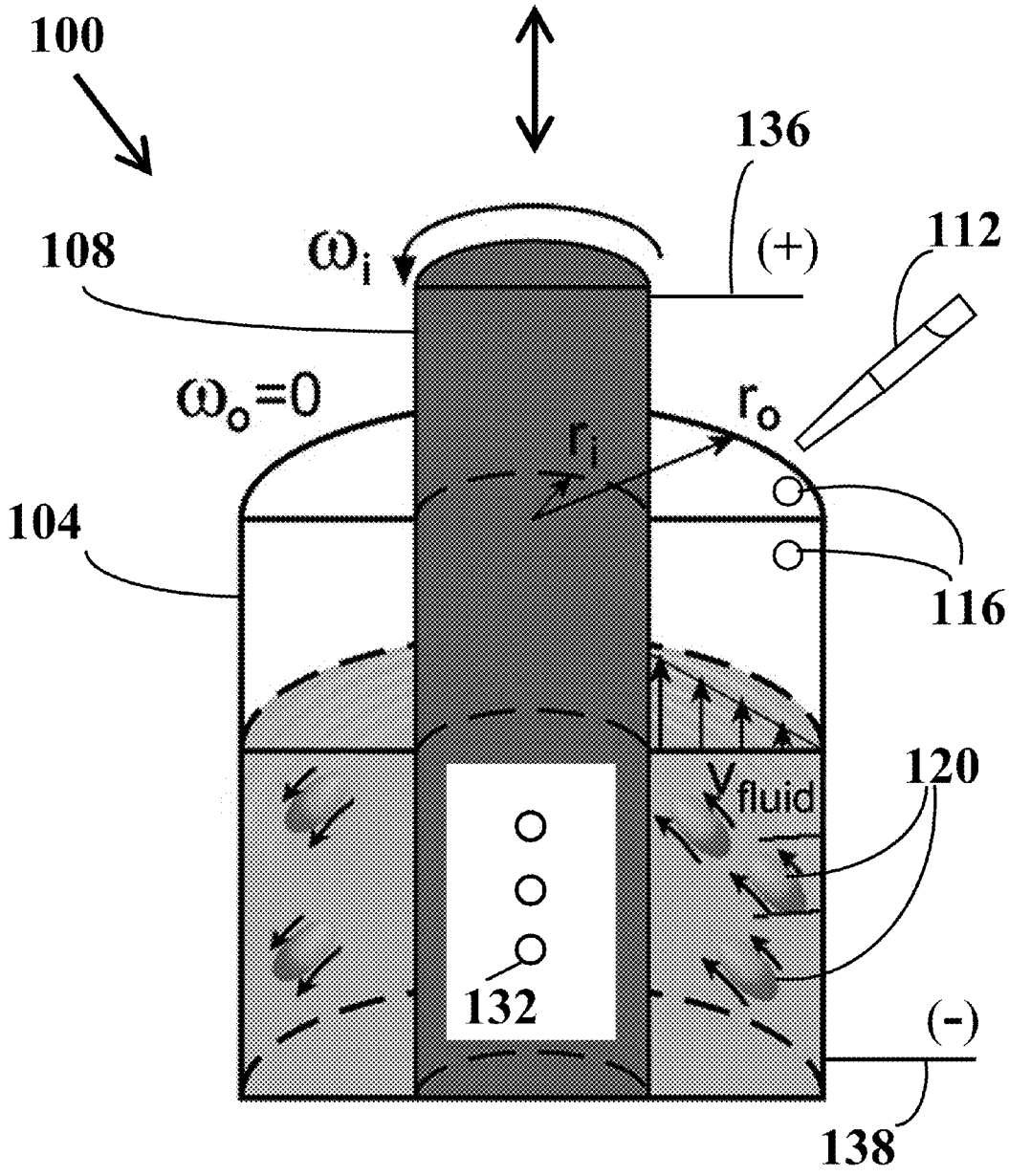
FIG. 1 is a cross-sectional view of an example of an apparatus or system that may be utilized for fabricating nanofibers in accordance with certain implementations of the present disclosure.

As used herein, the term nanofiber refers generally to an elongated fiber structure having an average diameter ranging from about 100 nm-5 μm in some examples, and in other examples ranging from 200 nm-2 μm. The "average" diameter may take into account not only the fact that the diameters of individual nanofibers making up a plurality of nanofibers formed by implementing the presently disclosed method may vary somewhat, but also that the diameter of an individual nanofiber may not be uniform over its length in some implementations of the method. In some examples, the average length of the nanofibers may range from 100 nm or greater. In other examples, the average length may range from 100 nm to millions of nm. In some examples, the aspect ratio (length/diameter) of the nanofibers may range from 100 or greater. In other examples, the aspect ratio may range from 20 to millions. In some specific examples, we have demonstrated nanofibers with aspect ratios of at least 10,000. Insofar as the diameter of the nanofiber may be on the order of a few microns, for convenience the term "nanofiber" as used herein encompasses both nano-scale fibers and micro-scale fibers (microfibers).

As used herein, the term nanorod refers generally to a structure having an aspect ratio (length/diameter) of less than 100.

As used herein, the term nanoparticle refers to any particle that may form a composite with a nanoparticle fabricated in accordance with the present teachings. The average size of nanoparticles may range from 1 to 100 nm. In the present context, the term "size" takes into account the fact that the nanoparticles may exhibit irregular shapes such that "size" corresponds to the characteristic dimension of the nanoparticles. For example, if the shapes of the nanoparticles are approximated as spheres, the characteristic dimension may be considered to be a diameter. As another example, if the shapes of the nanoparticles are approximated as prisms or polygons (i.e., rectilinear dimensions), the characteristic dimension may be considered to be a predominant length, width, height, etc.

As used herein, the terms "anti-solvent" and "coagulant" are used interchangeably unless specified otherwise.

The present disclosure describes an efficient and scalable method for processing polymer solutions into nanofibers (microfibers and nanofibers), which combines phase separation and shear forces. In one aspect, the method may be characterized as entailing a bulk process of antisolvent-induced precipitation under shear stress in viscous media. This approach differs significantly from existing technologies for creating nanofibers (e.g., electrospinning, bicomponent splitting, and melt-blowing) and overcomes a number of their limitations. This process does not rely on nozzles for polymer extrusion and therefore overcomes the major limitations of wet-spinning in terms of high feeding pressures, nozzle blockage, and use of particulate additives. Thus, the method may advantageously be employed for producing composite fibers incorporating nanoparticles. Moreover, the process is a scalable technique that can be tailored to produce fibers of a wide variety of polymers with diameters and lengths typically falling within the ranges indicated above.

In various implementations, the process entails the use of shear stresses in a liquid-liquid dispersion system to form and stretch nanofibers. Operationally, the actual formation of these nanofibers may be considered as being accomplished in just one or two steps, although the formation process may also be considered as entailing various sub-steps or events. According to certain implementations, a polymer solution is introduced into a dispersion medium. Any means for introducing the polymer solution may be employed (e.g., syringe, tube, etc.). The polymer solution includes a polymer dispersed in any solvent ("polymer solvent") capable of dissolving the polymer and forming a stable solution. Optionally, the polymer solution may additionally include one or more additives for various purposes such as, for example, to impart or enhance a certain function or property of the nanofibers being formed, to facilitate the process by which the nanofibers are formed, etc. The dispersion medium generally should be sufficiently viscous as to enable the nanofiber formation in the manner described herein. In particular, the viscosity of the dispersion medium should be high enough to provide a sufficiently high shear stress $\tau=\mu G$ for a given shear rate G. Additionally, the dispersion medium is or includes a component that behaves as an anti-solvent for the polymer of the polymer solution. The anti-solvent should be sufficiently miscible with the polymer solvent as to enable the nanofiber formation in the manner described herein. The polymer solution resides in the dispersion medium in the form of droplets dispersed throughout the volume of the dispersion medium. Depending on the nature of the polymer solution and the manner in which it is introduced, the polymer solution may enter the dispersion medium already in droplet form or may enter in a continuous stream and break up into droplets upon encountering the dispersion medium.

During the introduction of the polymer solution into the dispersion medium, the dispersion medium (now containing the polymer solution droplets) is sheared. Any means or device may be utilized to impart a shearing action to the dispersion medium in a batch or continuous process. In certain implementations, one or more surfaces confining the volume of the dispersion medium may be moved (e.g., rotated, translated, twisted, etc.) relative to one or more stationary or other moving surfaces. The shearing of the dispersion medium deforms the polymer solution droplets into liquid filament streams due to capillary instabilities. These filaments are further stretched under a mechanism of shear-force elongation. At the same time, the polymer solvent, being miscible with the dispersion medium, diffuses out from the droplets/filaments and into the dispersion medium. As a result, insoluble nanofibers composed of the polymer are formed. From the point in time at which the polymer solution begins to be added to the dispersion medium, the duration of time required to the form nanofibers in a batch process is typically on the order of a few seconds to a few minutes. In an apparatus such as described below with 6 ml volume, fibers may be formed at a rate of up to 0.1 g/min. Generally, the production rate should scale with the volume of the apparatus.

Optionally, the as-formed nanofibers may be composites that include nanoparticles, microparticles or other additives retained by the polymer component. In the present context, the term "retained" indicates that such nanoparticles, microparticles or other additives may be disposed on the outer surface of, and/or embedded in (or encapsulated by) the polymer component. Such nanoparticles, microparticles or other additives would typically be included in the polymer solution introduced into the dispersion medium. More generally, depending at least in part on the type of nanoparticles, microparticles or other additives, they may be introduced before or during shearing such as by being included in the polymer solution or by being introduced into the dispersion medium separately from the polymer solution. Alternatively, the nanoparticles, microparticles or other additives may be introduced after shearing such as by being introduced into the dispersion medium while the as-formed nanofibers are still resident in the dispersion medium, or by being added to the nanofibers by any suitable manner (e.g., coating, vapor deposition, etc.) after the nanofibers have been separated from the dispersion medium.

Once the nanofibers have been formed as described above, the nanofibers may be removed from the apparatus subjected to any desired post-fabrication procedures. For instance, the as-formed nanofibers may be subsequently washed with a low-viscosity anti-solvent, collected, and dried. The nanofibers may be utilized to produce nonwoven webs for various applications. The anti-solvent may be recycled and re-circulated to the apparatus after the polymer fibers are separated from the suspension. Additionally, the nanofibers may be processed or utilized as needed to fabricate any desired end-product.

A notable advantage of the present method is that it is not limited to the use of any particular polymer or class of polymers. Polymers encompassed by the present disclosure generally may be any naturally-occurring or synthetic polymers capable of being fabricated into nanofibers in accordance with the shear-driven nanospinning technique taught herein. Non-limiting examples of polymers include many high molecular weight (MW) solution-processable polymers such as polyethylene (more generally, various polyolefins), polystyrene, cellulose, cellulose acetate, poly(L-lactic acid) or PLA, polyacrylonitrile, polyvinylidene difluoride, conjugated organic semiconducting and conducting polymers, biopolymers such as polynucleotides (DNA) and polypeptides, etc. In typical implementations of the present method, linear high-MW polymers have a MW ranging from ~20,000-30,000 or greater for formation of high-aspect ratio fibers. Generally, higher MW ranges would likely be required for branched polymers. More generally, any molecular weight could be used without departing from the invention.

Other examples of suitable polymers include vinyl polymers such as, but not limited to, polyethylene, polypropylene, poly(vinyl chloride), polystyrene, polytetrafluoroethylene, poly(α-methylstyrene), poly(acrylic acid), poly(isobutylene), poly(acrylonitrile), poly(methacrylic acid), poly(methyl methacrylate), poly(1-pentene), poly(1,3-butadiene), poly(vinyl acetate), poly(2-vinyl pyridine), 1,4-polyisoprene, and 3,4-polychloroprene. Additional examples include non-vinyl polymers such as, but not limited to, poly(ethylene oxide), polyformaldehyde, polyacetaldehyde, poly(3-propionate), poly(10-decanoate), poly(ethylene terephthalate), polycaprolactam, poly(11-undecanoamide), poly(hexamethylene sebacamide), poly(m-phenylene terephthalate), poly (tetramethylene-m-benzenesulfonamide). Additional polymers include those falling within one of the following polymer classes: polyolefin, polyether (including all epoxy resins, polyacetal, polyetheretherketone, polyetherimide, and poly(phenylene oxide)), polyamide (including polyureas), polyamideimide, polyarylate, polybenzimidazole, polyester (including polycarbonates), polyurethane, polyimide, polyhydrazide, phenolic resins, polysilane, polysiloxane, polycarbodiimide, polyimine, azo polymers, polysulfide, and polysulfone.

As noted above, the polymer can be synthetic or naturally-occurring. Examples of natural polymers include, but are not limited to, polysaccharides and derivatives thereof such as cellulosic polymers (e.g., cellulose and derivatives thereof as well as cellulose production byproducts such as lignin) and starch polymers (as well as other branched or non-linear polymers, either naturally occurring or synthetic). Exemplary derivatives of starch and cellulose include various esters, ethers, and graft copolymers. The polymer may be crosslinkable in the presence of a multifunctional crosslinking agent or crosslinkable upon exposure to actinic radiation or other type of radiation. The polymer may be homopolymers of any of the foregoing polymers, random copolymers, block copolymers, alternating copolymers, random tripolymers, block tripolymers, alternating tripolymers, derivatives thereof (e.g., graft copolymers, esters, or ethers thereof), and the like.

As indicated above, the polymer solvent may generally be any solvent capable of dissolving the polymer being processed, and which is completely or partially miscible with the antisolvent dispersion medium to a degree sufficient for forming nanofibers in accordance with the present teachings. Complete or full miscibility generally means that two (or more) liquids are miscible with each other in all proportions. Partial miscibility generally means that the degree to which the two (or more) liquids are miscible with each other is not necessarily the same. Typically, partially miscible solvents have a solubility in each other of at least 5 g/L at 25° C. For convenience, the term "miscible" as used herein encompasses partial miscibility as well as full miscibility, consistent with the foregoing statements. Non-limiting examples of polymer solvents include chloroform ($CHCl_3$), acetone, toluene and other polar and non-polar organic solvents, water, water with varied pH values, water with varied salt concentration, dissolved and supercritical carbon dioxide, mixtures of two or more of the foregoing, and mixtures of one or more of the foregoing with other solvents.

Polymer solution concentrations typically range from 0.1 wt % to over 50 wt %, with generally lower wt % for higher MW polymers in order to achieve the optimal viscosities. More generally, however, the polymer solution concentration will depend on the polymer being utilized.

As indicated above, the dispersion medium may generally include any component or components that serve as an anti-solvent for the polymer being processed, but which is miscible with the polymer solvent being utilized. Stated in another way, the anti-solvent may be any liquid or solution in which the polymer does not dissolve. Non-limiting examples of dispersion media include various alcohols such as ethanol, methanol, isopropanol, glycerol or the like, and combinations of two or more alcohols such as glycerol/ethanol, as well as water. As an example, glycerol may be included to control the viscosity of the dispersion medium, with ethanol or water also included for its miscibility with the polymer solvent to provide a pathway for the polymer solvent to leave the fibers whereby the fibers can be stably formed. Various biopolymers, biomacromolecules, conditioners and thickeners may also be used to adjust the media viscosity.

In advantageous implementations, the viscosity of the dispersion medium ranges from about 1 cP or greater. In other implementations, the viscosity of the dispersion medium ranges from about 1 cP to 1500 cP (or higher). In advantageous implementations, the ratio $p=\mu_1/\mu_2$ of the viscosities of polymer solution and the dispersion medium ranges from ~0.1 to 100, with a range of p=~0.1 to 1 preferred for producing fibers with small diameter and size distribution.

In advantageous implementations, the shear stress applied to the dispersion medium while the polymer solution is added and the nanofibers are being formed ranges from about 10 Pa to 1000 Pa. In some specific examples demonstrated herein, the applied shear stress ranges from ~30 to ~100 Pa.

The insolubility of the polymer in the dispersion medium may be characterized in advantageous implementations as the polymer having a solubility in the anti-solvent of (or comprising) the dispersion medium of less than about 2 g/L at 25° C., preferably less than about 1 g/L, more preferably less than about 0.5 g/L, and most preferably less than about 0.1 g/L.

The concentration of the antisolvent medium will generally depend on the polymer-antisolvent interactions as well as the polymer-solvent interactions. For a system where the polymer is barely soluble in the solvent, minute amounts of antisolvent would be sufficient for the formation of fibers.

As noted above, an advantage of the method disclosed herein is that it does not require the use of nozzles. This feature enables the incorporation of additives without the risk of clogging a nozzle or unduly increasing the operating pressure of extrusion. Examples of possible additives include, but are not limited to, ceramics such as titania and zirconia, metals (e.g., silver, gold, etc.), metal alloys, metal oxides, metalloids (e.g., silicon, germanium, semiconductor and quantum dot forming materials etc.) and their oxides, graphite, carbon black, and carbon nanotubes (CNTs). Additives may be included for various purposes such as imparting to or enhancing a property or function of the nanofiber, for example strength, anti-bacterial activity, therapeutic activity, conductivity, magnetic behavior, porosity, hydrophobicity, selective permeability, selective affinity to various materials, adhesiveness, enzymatic or catalytic activity, biocompatibility, biodegradability, biological adhesion, biological recognition and/or binding, chemical inertness, polarity, selective retention and/or enrichment of analytes in analytical separation techniques, etc.

In addition to nanostructures and microstructures, other types of additives may be added to the polymer solution or the dispersion medium for various purposes. Examples include, but are not limited to, colorants (e.g., fluorescent dyes and pigments), odorants, deodorants, plasticizers, impact modifiers, fillers, nucleating agents, lubricants, surfactants, wetting agents, flame retardants, ultraviolet light stabilizers, antioxidants, biocides, thickening agents, heat stabilizers, defoaming agents, blowing agents, emulsifiers, crosslinking agents, waxes, particulates, flow promoters, and other materials added to enhance processability or end-use properties of the polymeric components. Such additives can be used in conventional amounts. These additives can be added before, during or after formation of the polymer dispersion and/or formation of the polymer fibers. In certain embodiments, a surfactant, such as a nonionic or anionic surfactant, is added to a solution comprising the fibers in order to enhance dispersion of the fibers in the solution, particularly where the fibers are in an aqueous solution.

Nanofibers produced according to the present disclosure may be solid, hollow, or porous. Hollow fibers, for example, may be formed by shearing double emulsions with polymer-containing droplets of various controlled sizes. When a double emulsion droplet is stretched by the shear flow in accordance with the presently disclosed method, as only one of the phases interacts favorably with the dispersion medium, a core-shell fiber may be fabricated. If the immiscible core of the fiber is a liquid, it may be subsequently washed out to create a hollow tube.

If the polymer solution is introduced into the shearing dispersion medium in the form of pre-formed droplets, e.g., as an emulsion, the length of the fibers that could be obtained may be limited by the size of the polymer droplets. This variation of the method may allow one to produce polymer rods, potentially with good control over length and aspect ratio, from high molecular weight polymers that normally form only fibers.

Nanofibers produced according to the present disclosure have a wide variety of applications. As a few non-limiting examples, polystyrene fibers may be utilized to fabricate disposable foam products. Nanofibers may be processed according to the present disclosure from recycled polystyrene and subsequently utilized to fabricate fiber-based products of higher value than recycled products fabricated from conventional techniques. Other examples include medical prostheses, textured surfaces and sensors (including implantable, ingestible and transdermal applications); scaffolds in tissue engineering; vehicles for delivery of biological or chemical materials; smart materials responsive to external stimuli (e.g., pH, light, heat, moisture), such as for customized heat response near the human body temperature, tuned pH/humidity response for protective clothing textiles, adjustable breathability, and combat-field materials for smart gas-mask filters with selective responses to virus, gas and other threats; electromagnetic shielding; protective clothing (including antibacterial, photo-protective, etc.); and electronic textiles such as flexible organic microcircuit textiles. Nanofibers produced from various polymers may be utilized in the fabrication of filters and barriers for nano-scale and micro-scale applications. Nanofibers spun from DNA may be utilized to create templates for biomimetic or biological materials. Polypeptides, proteins and their derivatives may be utilized to fabricate biocompatible fibers, silks, and many other products. Other examples of applications include those noted above in the background section of this disclosure.

FIG. 1 is a schematic view of an example of an apparatus or system 100 that may be utilized for fabricating the nanofibers. The apparatus 100 generally includes a container 104 for containing a volume of dispersion medium and receiving polymer solution, a structure 108 extending out from the container 104, and a dispensing device 112 for supplying the polymer solution to the dispersion medium. The dispensing device 112 may be of any suitable type for introducing the polymer solution (optionally with additives) into the dispersion medium from a suitable supply source (not shown). The container 104 and the structure 108 may be configured such that they both provide surfaces cooperatively defining the boundaries of the volume of the dispersion medium, and such that the container 104 and/or the structure 108 move. That is, the container 104 serves as an outer boundary or surface and the structure 108 serves as an inner boundary or surface, at least one of which moves relative to the other to effect shearing. In the present example, the container 104 is a stationary outer cylinder and the structure 108 is an inner cylinder extending upward from the inside bottom of the outer cylinder in a concentric arrangement along its center axis. The outer cylinder and the inner cylinder cooperatively define an annular cylindrical interior containing the dispersion medium. The inner cylinder is driven by a suitable motor (not shown) to rotate at a desired angular velocity about the center axis, as indicated by an arrow. The polymer solution supplying device 112 may be any suitable conduit or applicator that dispenses the polymer solution from its tip by any operating principle (e.g., pumping action, capillary action, etc.). Rotation of the inner cylinder relative to the stationary outer cylinder imparts a shear stress to the components contained in the outer cylinder. FIG. 1 illustrates polymer solution droplets 116 being dispensed into the outer cylinder 104 and droplets 120 undergoing shear in the dispersion medium, which as described below causes polymer solvent to diffuse out from the droplets 120 into the dispersion medium.

The apparatus 100 illustrated in FIG. 1 is advantageous in that it can generate uniform shear stress. Moreover, the shear stress may be highly tunable by changing one or more variables that control the shear stress proportionately, such as the viscosity of the dispersion medium (i.e., the shear medium), the shear rate (e.g., the revolution speed of the inner cylinder in the present example), and the gap between the outer cylinder and the inner cylinder. By controlling the shear stress, while keeping the shear stress uniform, one may control the final diameter of the uniform fibers produced by the apparatus 100. It will be understood that the present teachings are not limited, however, to the apparatus 100 illustrated by example in FIG. 1. Many other designs and types of apparatus may be suitable, but preferably are configured to enable the maintaining of uniform shear stress and control over the uniform shear stress as just described.

In the example illustrated in FIG. 1, the outer cylinder (container 104) has a radius of $r_o$ relative to its central axis, and the inner cylinder (structure 108) has a radius of $r_i$ relative to the same axis. The inner cylinder rotates at an angular velocity of $\omega_i$ and the outer cylinder is stationary ($\omega_o$=0). The dispersion medium is or approximates a Newtonian fluid such that its fluid velocity profile may be depicted as shown during rotation of the inner cylinder.

As an alternative, the apparatus 100 may be configured to rotate the outer cylinder 104 at an angular velocity of $\omega_o$ while the inner cylinder 108 remains stationary ($\omega_i$=0). In this case, the dispersion medium will have a different fluid velocity profile (not shown) in which the velocity vectors are largest near the rotating outer cylinder 104 and smallest near the stationary inner cylinder 108. Rotation of the outer cylinder 104 may be useful for operating at higher shear stress without the onset of turbulence. As indicated by an arrow in FIG. 1, in some implementations the apparatus 100 may be configured to reciprocate or oscillate the inner cylinder 108 along its axis, i.e., in an axial direction orthogonal to the radial gap between the outer cylinder 104 and the inner cylinder 108, which may further contribute to stabilizing the flow. In other implementations, the polymer solution may be delivered to the dispersion medium through openings 132 formed through the inner cylinder 108.

In still other implementations, an electrical field may be applied in a radial direction by applying a voltage potential between the outer cylinder 104 and the inner cylinder 108, as depicted schematically by a positive terminal 136 and a negative terminal 138. Alternatively, the apparatus 100 may be configured to apply an electrical field in an axial direction. Depending on the kinetics of the fiber formation, it is possible to permanently polarize electrostatically fibers containing polar side-group chains. Hence, fibers exhibiting anisotropic surface properties may be formed. It is also possible to displace the nanoparticles inside the polymer creating fibers with anisotropic bulk structure.

Figure 4:
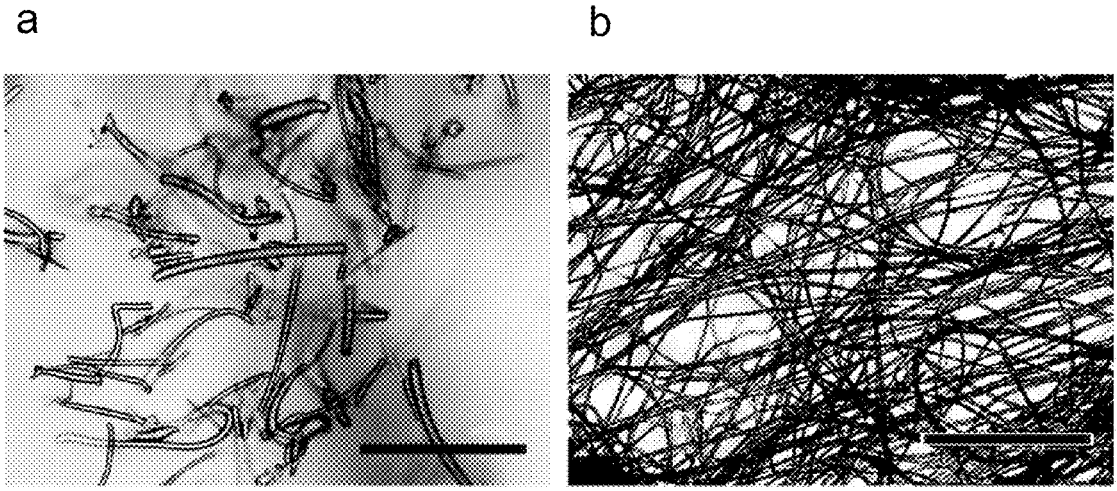
FIG. 4 is a set of optical micrographs of structures obtained from polystyrene solutions sheared in a medium containing 75% glycerol: 25% ethanol, sheared at 2000 rpm for 3 min: a) Short polymer rods formed from the 5.8 k molecular weight (MW) polymer. b) Long fibers formed from the 230 k MW polymer. All scale bars=100 μm.

FIGS. 2A to 2E illustrate the formation of either nanorods (FIG. 2D) or nanofibers (FIG. 2E) from polymer solution droplets (FIG. 2A), schematically depicting the mechanism of rod or fiber formation by way of solvent attrition under shear in accordance with the present teachings. After a polymer solution droplet is introduced into the dispersion medium, it becomes deformed due to shear stress (FIG. 2A). The droplet may break up into smaller droplets (FIG. 2B) until the shear forces are balanced by the interfacial tension forces. The droplets then elongate and stiffen as the polymer solvent diffuses out into the dispersion medium, thereby forming proto-fibers (FIG. 2C). The anti-solvent of the dispersion medium may coat the proto-fibers and may diffuse into the proto-fibers. As described further below, it has been discovered that the molecular weight (MW) of the polymer plays a role in the rod/fiber formation process. Specifically, it has now been found as a general case that low-MW polymers result in the formation of polymer rods (FIG. 2D) whereas high-MW polymers result in the formation of polymer fibers (FIG. 2E). It is hypothesized herein that the higher MW of the fiber-forming polymers is associated with a high level of molecular entanglement of the polymer solution, whereas lower MW is associated with low entanglement levels leading to rod formation. Images of examples of such rods and fibers are illustrated in FIGS. 4A and 4B, respectively, and referred to below.

Without wishing to be bound by any particular theory, the following discussion of the mechanism of rod or fiber formation by way of solvent attrition under shear in accordance with the present teachings is provided. A droplet immiscible with a sheared Newtonian fluid medium is deformed under the influence of two forces—shear stress, which would deform it, and interfacial tension, which would minimize the droplet surface area and confine it to a sphere. The balance of those two forces can be quantified by the dimensionless capillary number Ca:

$$Ca = \frac{\tau a}{\gamma}, \quad \text{where } \tau \approx \frac{\mu \omega_i r_i}{d}. \tag{1}$$

Here, $\tau$ is the shear stress, a is the droplet radius, and $\gamma$ is the interfacial tension, $\mu$ is the fluid viscosity, $r_i$ and $\omega_i$ are the radius and angular velocity of the inner cylinder, respectively, and $d=r_o-r_i$ (FIG. 1). For low Ca, the surface tension dominates and the droplet remains close to spherical. For high Ca, the shear stress dominates and the droplet stretches into a long cylinder. At a critical value, $Ca_{cr}$, which is a function of the ratio $p=\mu_1/\mu_2$ of the viscosities of the droplet and the media, the cylinder breaks up into smaller drops due to Rayleigh and other instabilities, such as tip-streaming. For viscosity ratios $p>3$, $Ca_{cr}$ diverges, so it is almost impossible to break up the droplet. For $0.1<p<3$, $Ca_{cr}$ varies between 0.3 and 1. For $p<0.1$, $Ca_{cr}$ increases for break up due to drop fracture, but a second tip-streaming mechanism appears with a constant $Ca_{cr}=0.5$ for all $p<0.1$. See Mabille et al., *Europhys. Lett.,* 2003, 61, 708; Sugiura et al., *J. Phys. Chem. B,* 2002, 106, 9405; Rallison, *Annu. Rev. Fluid Mech.,* 1984, 16, 45; Li, *Phys. Fluids,* 2000, 12, 269; and Grace, *Chem. Eng. Commun.,* 1982, 14, 225. Thus, in the process of polymer fiber formation described above, the polymer droplets deform and break up in the shear flow until they reach a critical size, which is determined by the capillary number Ca as well as the competition between the shear extension and diffusion. At the critical size, the polymer solvent leaves the droplets, and the droplets thereby become solidified in the deformed state. Further explanation and description of the mechanism of fiber formation according to the present teachings is provided below in conjunction with experimental Examples.

Aspects of the fiber formation process taught herein—e.g., the use of an anti-solvent medium miscible with the polymer solvent, the use of a solution including a polymer having an appropriate molecular weight, the generation of moderate to high shear stresses, etc.—are readily amenable to scale-up for industrial and commercial applications. Accordingly, no limitation is placed on the dimensions of the apparatus utilized to carry out the process. In the case of an apparatus based on a cylindrical drum inside a cylindrical enclosure with one or both of these components rotating, such as illustrated by example in FIG. 1, the diameters and lengths of the cylinders may, for example, be on the order of meters. A large-scale apparatus may be capable of producing a large number of fibers of significant length. Means may be provided to assist in removing fibers from the apparatus. For example, long fibers may become wrapped about a rotating inner cylinder. The inner cylinder may be provided with small, retractable drums or other structures (not shown) that cut or remove as-produced fibers upon activation by a user.

Figure 3:
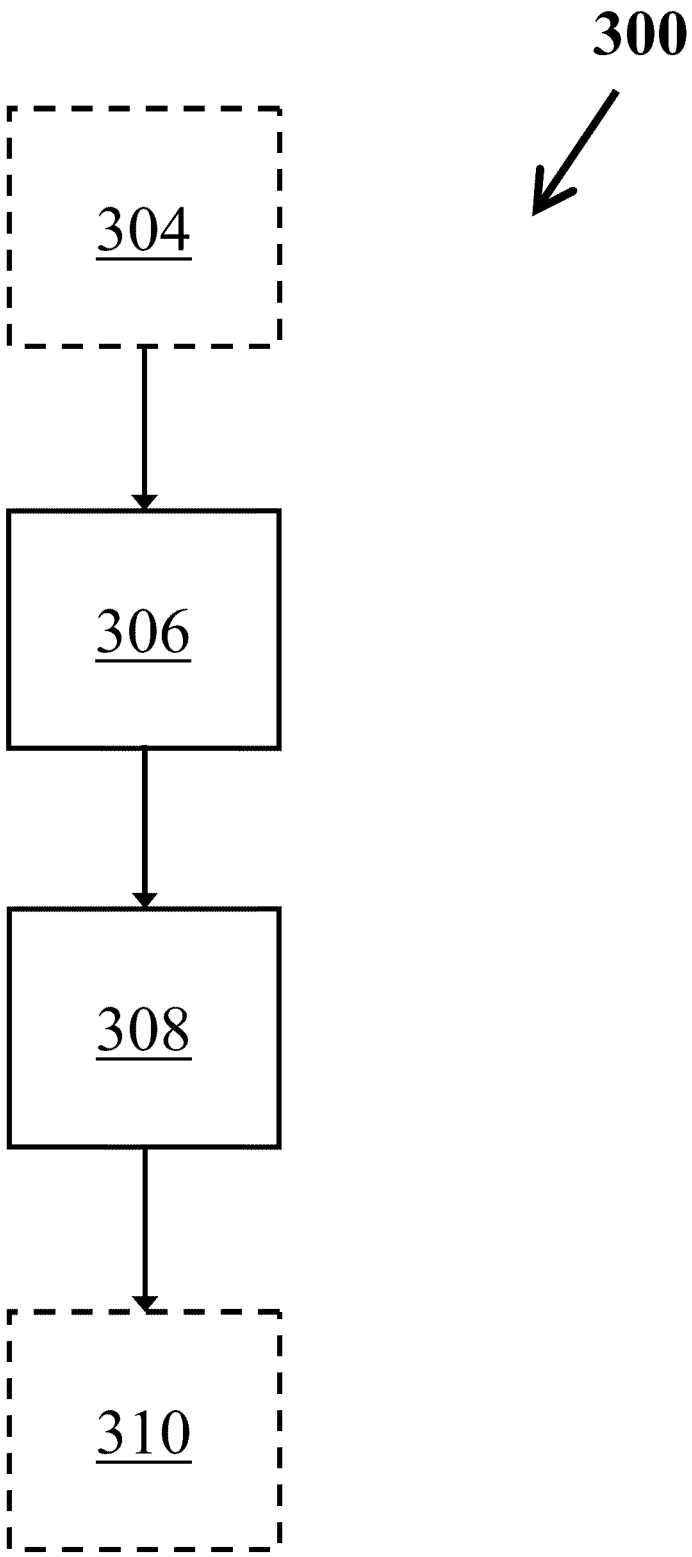
FIG. 3 is a flow diagram illustrating an example of a method for fabricating polymer nanofibers in accordance with the present disclosure.

FIG. 3 is a flow diagram illustrating an example of a method 300 for forming polymer nanofibers. Optionally, at block 304, any desired or necessary pre-formation steps may be taken. Such pre-formation steps may include preparing the polymer solution, adding nanoparticles or other additives as desired. At block 306, the polymer solution is introduced into a dispersion medium. At block 308, shear is imparted to the dispersion medium to form polymer fibers from the polymer solution. Optionally, at block 310, any desired or necessary post-formation steps may be taken. Such post-formation steps may include removing the fibers from an apparatus in which the fibers were formed, washing and drying the fibers, incorporating the fibers into a product, etc. The flow diagram illustrated in FIG. 3 may also schematically represent an apparatus or system 300 configured for carrying out the process steps just described. Additional apparatus features used for fiber alignment, extension, extraction and other processing may be included as needed.

In an alternative implementation, a method for fabricating polymer strands or strings is provided. The polymer of the polymer strands may have a molecular weight of less than about 20,000 Da. Similar to the methods described above, the polymer strands may be formed by introducing a polymer solution into a dispersion medium and shearing the dispersion medium. In this case, the resulting polymer strands having an aspect ratio of about 100 or less. Unlike previously fabricated polymer rods (U.S. Pat. No. 7,323,540, commonly assigned to the assignee of the present disclosure, the content of which is incorporated by reference herein in its entirety), the polymer strands are not necessarily straight or rigid. The strands may be utilized in a wide variety of applications and articles of manufacture for which relatively short, non-rigid polymer fibers are desirable.

EXAMPLES

For the following experiments, high molecular weight (MW) polystyrene (PS) was obtained from Aldrich (430102, $M_w \approx 190{,}000$-$230{,}000$, $M_w/M_n \approx 1.6$). Low MW PS was obtained from Pressure Chemical (Pittsburgh, Pa.), with $M_w=5{,}780$, $M_w/M_n=1.05$. Cellulose acetate from Aldrich was used (180955, average $M_n \sim 30{,}000$ by GPC). Poly (L-lactic acid) from MP Biomedicals (151931, $M_w \sim 700{,}000$), chloroform ($CHCl_3$) (Acros 61003-0040), and denatured alcohol (Fisher A995-4), containing 90% ethanol and ~5% each of methanol and isopropanol, were obtained through Fisher Scientific. Nanoparticles of oleic acid capped iron oxide nanocrystals (10 nm) were obtained from Ocean NanoTech (Fayetteville, Ak.). These nanoparticles were easily suspended in $CHCl_3$.

A lab scale Couette flow apparatus, similar to the apparatus 100 illustrated in FIG. 1, was constructed by combining a mixer with a straight cylindrical shaft and a centrifuge tube. The mixer was a Cole-Parmer Servodyne Model #50003 with digitally controllable speeds (150-6000 rpm). Polypropylene centrifuge tubes (17×100 mm, ID=14.6 mm, Evergreen Scientific), obtained through Fisher Scientific, acted as the stationary outer cylinder wall in the device. The radii for the shaft, $r_i$, and the stationary tube, $r_o$, were 5.00 mm and 7.32 mm respectively. Clamping a disposable tube to a bench stand and centering it around the bare rotating shaft resulted in an easy-to-clean setup where only the shaft had to be wiped clean after each experiment.

In these experiments, 0.2 ml of polymer solution was quickly injected in the 2.3 mm gap between the rotating shaft and the stationary tube, which contained about 6.6 ml of shearing fluid. The most common shearing medium was 75% glycerol:25% ethanol (v/v), with dynamic viscosity $\mu=0.15$ Pa s and density $\rho=1140$ kg $m^{-3}$. Various rotor speeds were used to shear the solution, usually 2000 rpm ($\omega_i=209$ rad $s^{-1}$, $\omega_o=0$, FIG. 1), for 2-5 min. Polymer solution droplets were introduced into the flow where they were broken up and deformed until the polymer solvent diffused out into the antisolvent medium. The resulting fibers were subsequently removed from the shearing medium and the shaft, washed with the antisolvent (usually ethanol) and dried before imaging in either optical or scanning electron microscopy (SEM).

SEM images were obtained on a Hitachi S-3200N SEM after applying 6-12 nm of Au/Pd sputter coat to minimize charging and improve resolution. Beam energies of 5 kV, with low beam current and short working distance were used to increase resolution. TEM images were obtained on a JEOL 2000FX HRTEM at Atomic Resolution Electron Microscopy Center (AREMC).

Fiber diameter distributions were measured by analyzing SEM images containing 20-30 fibers each and with a minimum resolution of 800×800 pixels. Fiber diameters were measured in pixels, scaling by the image-embedded scale bar, and building a distribution histogram. At least 50 measurements were made to characterize the fibers for each processing condition.

Figure 2:
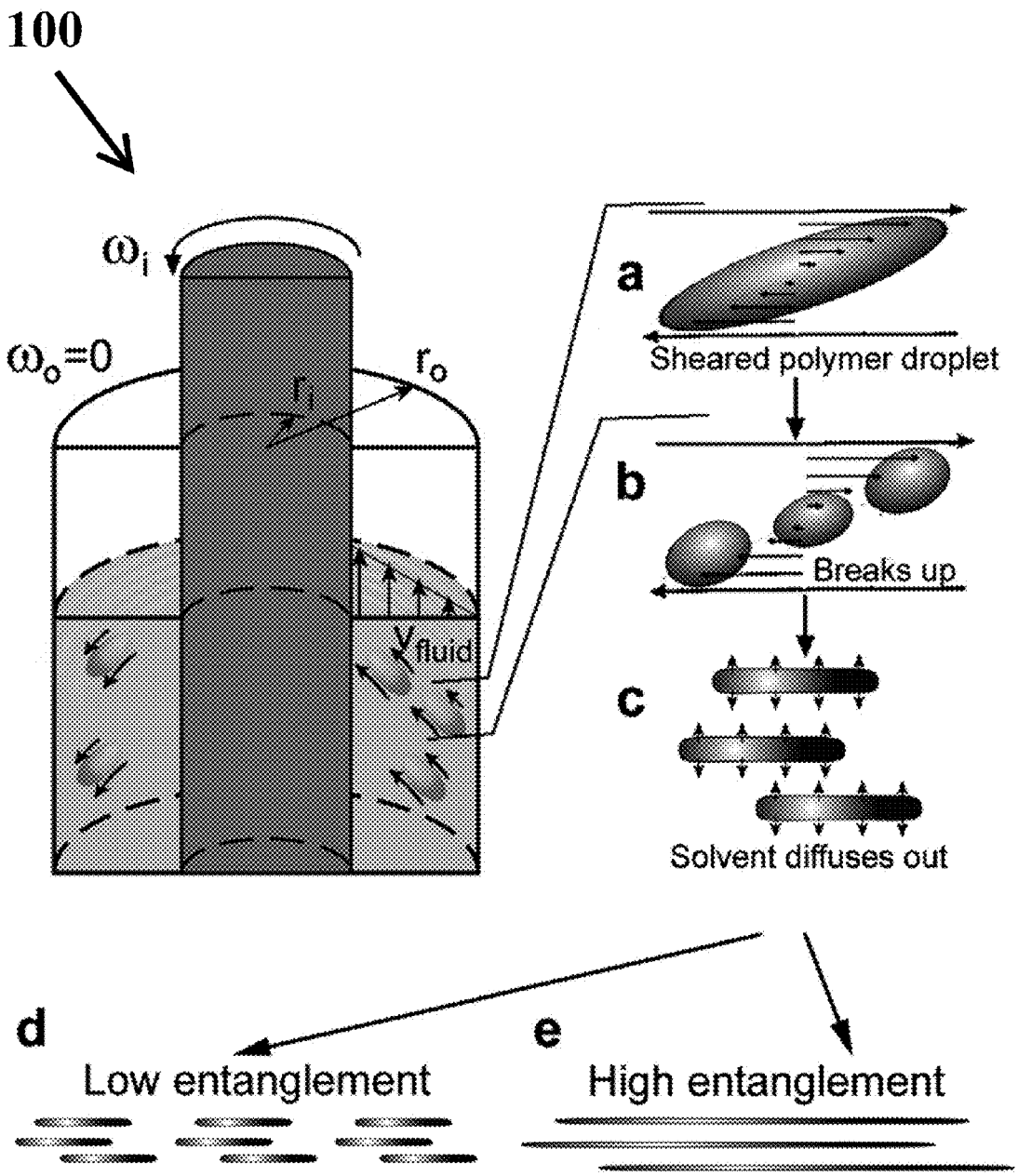
FIGS. 2A to 2E illustrate the formation of either nanorods (FIG. 2D) or nanofibers (FIG. 2E) from polymer solution droplets in accordance with the present teachings.

The main parameters for the current process were as described earlier in this disclosure: a) use of a viscous medium that provides high shear stress $\tau=\mu G$ for a given shear rate G, b) a polymer solvent which is miscible with the shearing medium, and c) the medium is/contains an antisolvent for the polymer. As illustrated in FIG. 2, nanofibers are produced in two steps. First, the polymer droplets deform and break up in the shear flow until they reach a critical size, determined by the capillary number as well as competition between the shear extension and diffusion. Second, at the critical size, the polymer solvent leaves the droplets, solidifying them in the deformed state. The lab-scale Couette flow device used in this experiment provided uniform shear stress throughout its entire volume and a simpler geometry for modeling the process. As described below, experiments with several common polymers resulted in the fabrication of fibers instead of rods, unlike the SU-8 polymer microrods fabricated from SU-8 solutions sheared in glycerol/ethanol mixtures previously. See U.S. Pat. No. 7,323,540, referenced above; Alargova et al., *Adv. Mater.,* 2004, 16, 1653; and Alargova et al., *Langmuir,* 2006, 22, 765.

Disregarding polymer-solvent interactions for a moment, it is hypothesized that the origin of this difference is due to the higher molecular weight of the fiber-forming polymers $M_n \sim 30{,}000$-$700{,}000$ vs. the low molecular weight of SU-8, $M_n \sim 7000 \pm 1000$. A high level of entanglement of the polymer solution may be necessary for producing the fibers (FIG. 2E), while low entanglement levels would lead to polymer rod formation (FIG. 2D). This finding may facilitate formulating the necessary conditions for solution nanospinning of fibers or rods from a wide variety of polymers.

Polystyrene (PS) solutions in chloroform were chosen to test the hypothesis, because PS could be obtained with vastly different molecular weights, while keeping the same polymer-solvent interactions in the system. Indeed, by performing the experiment with two batches of polystyrene of molecular weight (MW)=5.8 k and 230 k respectively, under nearly identical conditions, short rods (FIG. 4A) were obtained for the low molecular weight polymer, and long fibers (FIG. 4B) were obtained for the high molecular weight polymer.

Several process variables that might affect the diameters of the resulting fibers were identified. High MW PS solutions were used in these tests and shed light on the mechanism of fiber formation. First, the effect of the initial polymer solution concentration (FIG. 5B) was studied. The fibers formed at concentrations of 10-20% w/w PS in chloroform had similar diameters, within the error of the measurements. Interestingly, lower initial concentrations (4% w/w PS) did not result in fiber formation. This is likely caused by a tip-streaming breakup mode for the low viscosity droplets (at $p_{crit} \leq 0.1$). Tip streaming is also a probable reason why dilute SU-8 polymer solutions produced no rods for values of p close to or <0.1. See Alargova et al., *Langmuir,* 2006, 22, 765. At high concentrations (30% w/w PS) only irregular PS chunks were recovered, likely because the high viscosity of the droplets prevented their stretching before they could solidify.

It should be noted that for droplets containing solvent miscible with the medium, as in the present experiment, the hydrodynamic analysis in the experimental section only describes the behavior of droplets >5-10 μm. During the flow timescale ($G^{-1}$, ≈2 ms for ω=2000 rpm), which governs droplet deformation, the diffusion length in the 75% glycerol:25% ethanol medium is only a fraction of a micron, so the droplets and shearing medium can be approximated as immiscible phases. When the droplet is stretched into a thin cylinder with micron dimensions, however (FIG. 2C), the diffusion effects become significant. The solvent leaving the droplet increases the polymer concentration inside the cylinder, and in addition antisolvent from the medium forms a sheath of hardened, coagulated polymer at the cylinder surface.

Second, the effect of shear stress was characterized, since it determines the value of the capillary number Ca and the smallest sizes of deformable drops (Eqn. 1). At low rotation velocities (≤500 rpm), the polymer did not completely separate into fibers, coagulating into large, bulky strands and networks. At $\omega_i$>4000 rpm, turbulence in the solution during shear and a corresponding increase in the variation of fiber diameters were observed. Surprisingly, for angular velocities $\omega_i$=1000-3000 rpm (τ≈34-102 Pa) the fibers produced showed no statistically significant changes in diameter (FIG. 5A).

Figure 5:
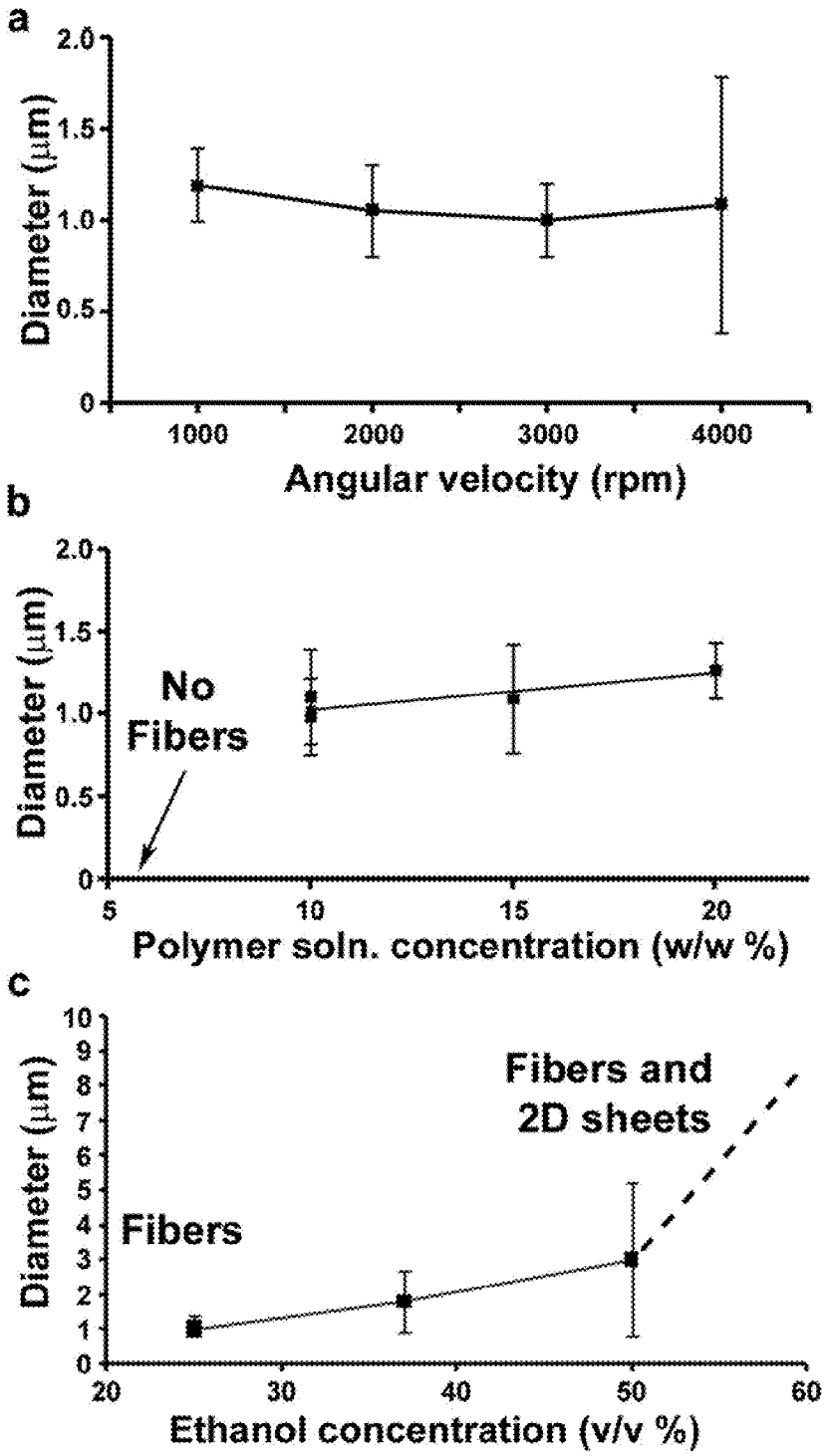
FIG. 5 is a set of data demonstrating the dependence of fiber diameters on values of processing parameters: a) Effect of shear stress τ. At $\omega_i$=4000 rpm, turbulence leads to a wide fiber diameter distribution. b) Effect of polymer solution concentration. No fibers were observed for either c=4% or c=30% (w/w in $CHCl_3$). c) Effect of shearing medium composition. Increasing the ethanol (antisolvent) concentration significantly increased the diameter of the larger fibers produced though the smallest fiber diameters remained fairly constant. For concentrations of ethanol <20%, no fibers were observed. For concentrations >50% ethanol, a significant fraction of the precipitated polystyrene was in the form of thin polymer sheets.

In the third experimental cycle, the amount of ethanol (antisolvent) in the shearing medium was changed (FIG. 5C). Though this change directly affects the polymer-antisolvent medium interactions, predictions from hydrodynamic dimensional analysis may be helpful for understanding the results. The maximum value of the medium viscosity $\mu_2$ for which fibers are formed is limited by the tip-streaming breakup instability for all $p=\mu_1/\mu_2<p_{crit}\approx 0.1$ (need $\mu_2<10\mu_1$). For 0.1<p<2, the critical capillary number $Ca_{cr}$ is near its minimum $Ca_{cr}\approx 0.4$ and almost constant. For this range of p a lower $\mu_2$, e.g., from more EtOH in the medium, also results in a lower shear stress $\tau=\mu_2 G$, and therefore a larger radius a of the stretched polymer solution cylinders that form the fibers (Eqn. 1). Therefore, one expects the average fiber diameter to be a decreasing function of viscosity, achieving a minimum value for value for $\mu_2$ just below $10\mu_1$, beyond which no fibers would be formed.

Indeed, for ethanol concentrations [EtOH]≤20% v/v, no fibers were formed. [EtOH]=25% v/v produced the smallest average diameter fibers. For 25%<[EtOH]<63% v/v, the average fiber diameter increased rapidly with increasing [EtOH], as did the polydispersity of the fibers. In addition to lowering the medium viscosity, high [EtOH] also increased the antisolvent property of the medium and its diffusion coefficient, which could also be a reason for the observed increase in fiber diameters. Faster antisolvent diffusion competing with hydrodynamic deformation, which stretches droplets into smaller and smaller diameter cylinders, would result in larger diameter fibers due to earlier fiber solidification.

The Couette flow utilized in the production of the fibers of this Example is known to become unstable above certain angular velocities, as originally discussed in detail by Taylor. See Taylor, *Phil. Trans. R. Soc. Lond. A—Math. Phys. Sci.,* 1923, 223, 289. The angular velocity at which the flow becomes unstable, is given by the Taylor number Ta:

$$Ta = \frac{r_i(r_o - r_i)^3(\omega_i^2 - \omega_o^2)}{\nu_2^2}, \quad (2)$$

where $\nu_2=\mu_2/\rho_2$ is the kinematic viscosity, $\mu_2$ and $\rho_2$ are the dynamic viscosity and the density of the shearing medium, and $r_{i,o}$, $\omega_{i,o}$ are as labeled in FIG. 1. The critical Taylor number for onset of turbulence under ideal conditions is $Ta_c\approx 1700$. See Chandrasekhar, *Proc. Royal Soc. London Ser. A—Math. Phys. Sci.,* 1962, 265, 188; and Snyder, *Proc. Royal Soc. London Ser. A—Math. Phys. Sci.,* 1962, 265, 198.

The turbulence observed for $\omega_i$≥4000 rpm contributes to non-uniformity in the fiber diameters (FIG. 5A). The Taylor number at $\omega_i$≥4000 rpm (Ta≥650), however, is much lower than the theoretical Taylor number. The likely reason for this severe deviation from ideal behavior is the instability of the open interface between the shearing medium and the air, though minute misalignments of the rotor leading to non-uniform gap spacing might contribute as well.

Placing baffles, which would eliminate the open air interface and its destabilizing end effect, may be the best way to achieve higher stress levels without turbulence. Following that one could also make use of additional strategies that have been reported for stabilizing the flow, though some are not directly applicable to the device utilized in this Example. Most involve modulating the speed of the rotor, introducing liquid flow in the axial direction, or periodic movement of the central cylinder in the axial direction. Another strategy follows from the inverse square dependence of Ta on medium viscosity $\mu_2$ (Eqn. 2). A more viscous shearing fluid would stabilize the flow by lowering Ta.

If the final size of the fibers were determined by hydrodynamic effects alone, one would expect their diameter to depend on the shear stress in solution. For a constant critical capillary number, a threefold increase in shear stress would result in a threefold decrease in fiber diameter (Eqn. 1). If diffusion effects dominate over the fiber diameter deformation process, one still expects a factor of $\sqrt{3}\approx 1.7$ decrease in fiber diameter. For shear stress changes in the range of τ≈34-102 Pa, no such change was observed (FIG. 5A).

The diameters of fibers of the present Example are at least an order of magnitude smaller than those of most wet-spun fibers, and determining the mechanism of their formation may enable the process to be optimized. A small number of tiny polymer fibrils (~200 nm, with occasional ones ~100 nm) was observed under most conditions, including varying antisolvent concentration in the medium. This result points towards a phase-separation mechanism governing the final fiber formation. The exact instability mechanisms leading to the formation of very thin fibers are still not understood completely. However, a judicious combination of parameters clearly leads to formation of submicron fibers.

SEM images of cross-sections of the fibers of the present Example, obtained after fracturing fiber bundles in liquid nitrogen (FIG. 6E,F), contain further clues about the phase-separation mechanism. Fibers with diameters below ~1 μm lack internal voids, while larger ones have only one or two small pores. The lack of macrovoids is particularly interesting, since they are typically observed in most wet-spun fibers. Macrovoids (pores of size 50 nm-3 μm) are well-described in the literature, and their formation proceeds as coagulant from the medium diffuses into the proto-fiber and polymer solvent diffuses out of it (FIG. 7). Skin formation occurs almost immediately as a result of contact between the coagulant and polymer solution, followed by interdiffusion of coagulant in and polymer solvent out through this skin. Phase separation, by either a nucleation and growth or spinodal decomposition follows inside the fiber region. Both mechanisms have been observed experimentally, sometimes even for the same polymer system under different spinning conditions. It is believed that, for the fibers of the present Example, the initial hydrodynamic deformation of the polymer solution was rapid enough to lead to a cylinder of a small enough diameter that phase separation and shear forces prevented void formation.

One important question related to this mechanism of formation is whether a characteristic phase-separation length scale exists that would fundamentally limit the smallest size of such fibers. Spinodal decomposition in membrane formation leads to small and uniform (~50-200 nm) voids. In this Example, the pores observed in the larger diameter fibers and the diameters of the smallest fibers have similar sizes, suggesting phase separation as the likely cause in their formation. Focusing on conditions that affect the dynamics of the phase separation process may be the way to achieve the smallest possible fiber diameters.

Figure 6:
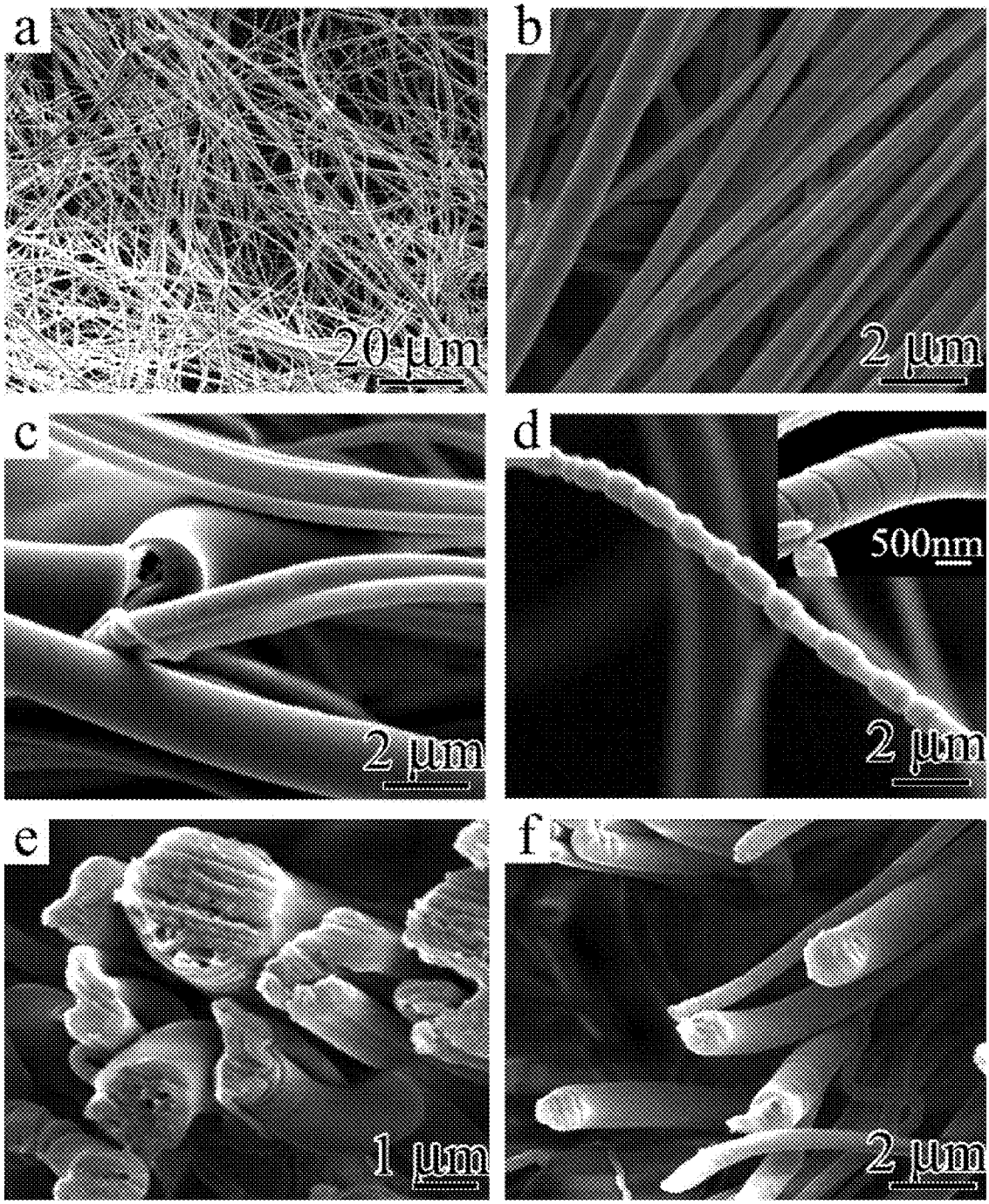
FIG. 6 is a set of scanning electron microscopy (SEM) micrographs of PS fibers formed from 15% solution (w/w in $CHCl_3$) sheared into 75% glycerol: 25% ethanol at 2000 rpm. a, b) Typical fibers shown. The diameters ranged from ~200 nm to ~2 μm and the average size was ~500 nm. c) SEM micrograph showing a rare broken fiber with a void space in its interior. Cross-sectional SEM and TEM imaging showed fiber interiors were solid polymer. d) Approximately 5% of the fibers have an uneven surface, which upon closer examination was considered to be due to a series of closely-spaced necking deformations with constant diameter sections in between. e, f) Cross-section of fibers after fracturing in liquid nitrogen. e) Larger fibers with diameters >~1 μm have a few small pores, but no such pores are observed in f) smaller fibers.
Figure 7:
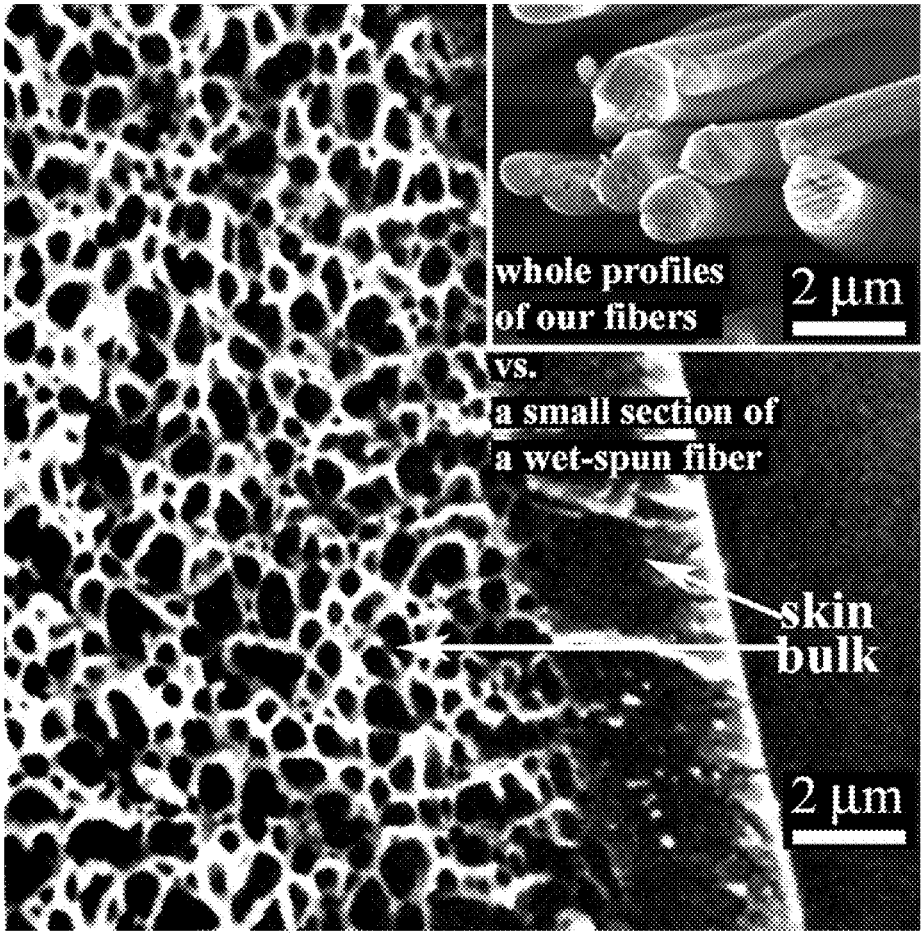
FIG. 7 is a SEM micrograph showing a same-scale comparison of a partial cross-section of a typical wet-spun fiber and cross-sections of nanospun PS fibers (inset) formed by the present teaching. The outer skin of the wet-spun fiber (2-3 μm) has a different morphology from the macropore-filled bulk of the fiber. The skin is produced by quick precipitation of the polymer when it comes in contact with the polymer solution. The macropores inside the fiber result from the slower diffusion of solvent through this skin barrier and subsequent phase-separation processes. The fibers formed by the present teaching have diameters much smaller than the skin layer, so it is likely that they are produced by the precipitation mechanisms analogous to ones that form a wet-spun fiber's skin.

Another feature, observed on about 5% of the fibers formed, is the presence of multiple necking deformations (FIG. 6D). Some fibers were heavily decorated almost along their entire length, while the rest of the fibers were uniform and smooth. One hypothesis is that a fraction of the fibers experienced higher than usual shear stresses and their stiffer skin broke in places, revealing the longer-stretching inner core. Such multiple necking has been observed previously in electrospun nanofibers and attributed to a stretching deformation. It was noted in that case that larger fibers only fail with one or two necking deformations. The alternative reason given for the multiple necking of nanofibers is a perturbation wavelength on the order of 50× the fiber diameter, and that multiple wavelengths fit over the fiber length observed. In the present experiment, however, the distance between necking deformations is similar to the diameter of the fiber, which is inconsistent with that hypothesis. The smooth cylindrical surface and constant diameter of the sections between necks (FIG. 6D) also supports the skin-core explanation.

Small angle X-ray scattering (SAXS) experiments may be utilized to verify the presence of the skin-core morphology, accurately measure the fiber skin thickness, and possibly determine its crystallinity. Additional experiments may be carried out to decouple the separate roles which shear stress and phase separation play in this complex nanofiber formation process. In wet-spinning, interactions with the solvent can cause polymer crystallization. The δ-crystal form of syndiotactic polystryrene (sPS), for example, not only contains solvent molecules but its crystallization is often induced by the solvent molecules. On the other hand, in the absence of polymer-solvent interactions in polypropylene melts, shear has been shown to cause polymer orientation in a skin layer and also induce crystallization. The diameters of the fibers of the present Example are similar or smaller than the skin thickness of typical wet-spun fibers (FIG. 7), implying a similar potential role of phase-separation in both structures. X-ray structural comparisons may yield information on the role of shear stress.

Figure 8:
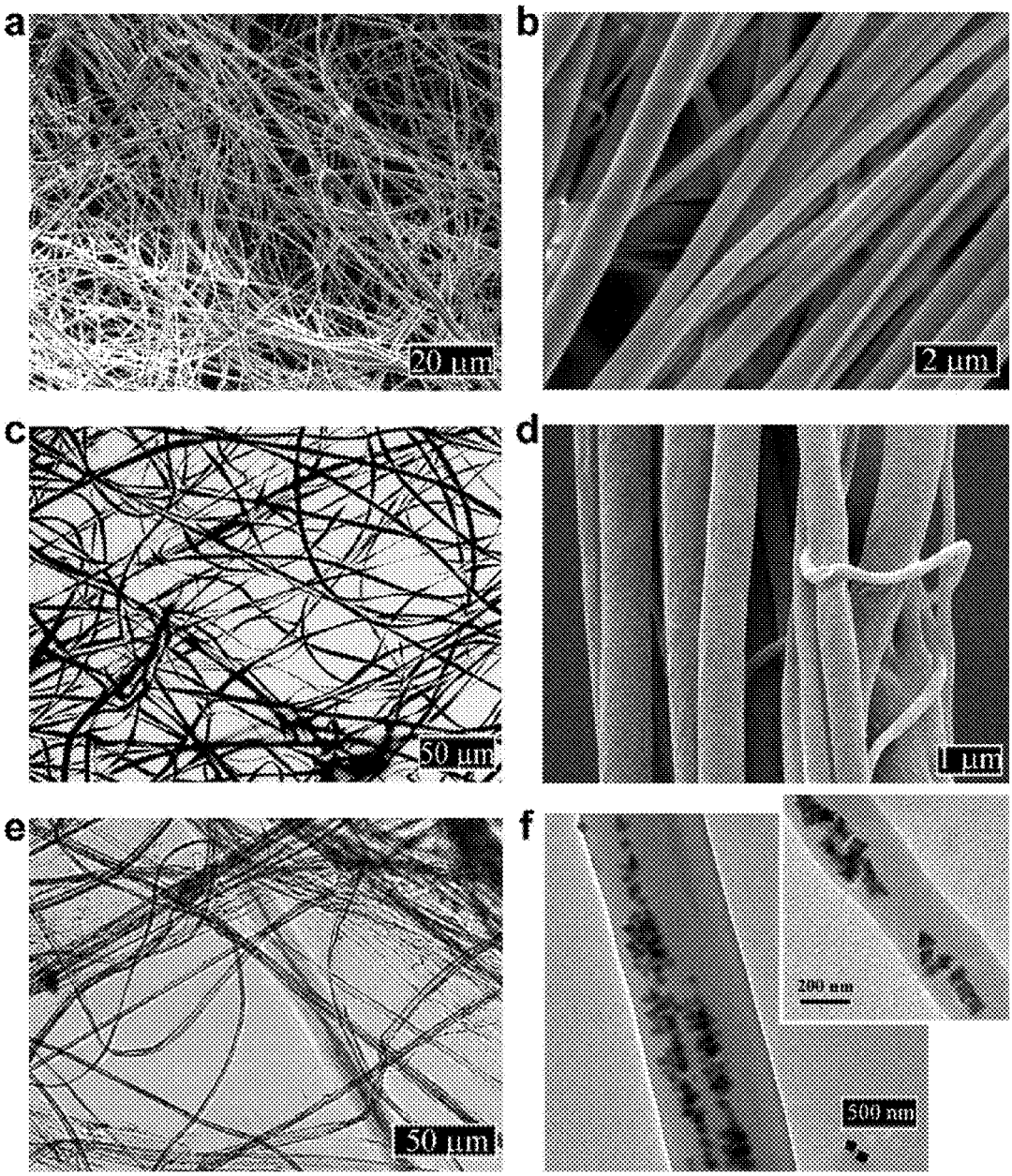
FIG. 8 is a set of optical micrographs illustrating the following: a) SEM micrographs of PS fibers formed from 15% solution (w/w in $CHCl_3$) sheared into 75% glycerol: 25% ethanol at 2000 rpm. b) High resolution SEM of the fibers in a). c,d) Optical and SEM micrographs of cellulose acetate (CA) microfibers, produced by shearing a 10% CA solution (w/w in acetone) into a medium with 75% glycerol: 25% water (v/v) at 2000 rpm for 2 min. e) Poly-lactic acid fibers (PLA), produced by shearing a 1% PLA solution (w/w in $CHCl_3$) into a medium with 37% glycerol: 63% ethanol (v/v) at 2000 rpm for 8 min. f) TEM micrograph of a composite PS fiber containing magnetite ($Fe_3O_4$) nanocubes. The fibers were produced by shearing a PS solution (10% w/w in $CHCl_3$, containing ~0.5% w/w $Fe_3O_4$ nanoparticles) into a 75% glycerol: 25% ethanol medium at 2000 rpm for 3 min. SEM micrographs of PS fibers formed from 15% solution (w/w in $CHCl_3$) sheared into 75% glycerol: 25% ethanol at 2000 rpm.

FIG. 8A is an SEM micrograph of PS fibers formed from 15% solution (w/w in $CHCl_3$) sheared into 75% glycerol:25% ethanol at 2000 rpm, and FIG. 8B is a high resolution SEM of the fibers in FIG. 8A. The method presented here, however, can be used in many systems, as the formation of fibers is not limited to polystyrene alone. To demonstrate the versatility of the method, other fibers were formed from two widely used, industrially important materials: cellulose acetate (FIGS. 8C and 8D), commonly used in filter manufacturing, and polylactic acid (PLA) (FIG. 8E), a renewable, biodegradable and biocompatible material used in tissue engineering and drug delivery. SEM images (FIGS. 8C and 8D) of the cellulose acetate fibers show that their diameters varied between 800 nm-2 μm with occasionally smaller and larger fibers. The method also has specific strengths in making fibers with embedded nanoparticles. The formation of polymer fibers containing solid nanoparticles by any process with nozzles is problematic as the particles often cause clogging due to aggregation. The nozzle-less shear nanospinning technique disclosed herein avoids this problem. The fabrication of magnetic composite fibers (FIG. 8F) was demonstrated by dispersing magnetite ($Fe_3O_4$) nanocubes in a solution of polystyrene in $CHCl_3$, and shearing the mixed suspension/solution in a glycerol/ethanol medium. Incorporation of various nanoparticles would make it possible to endow fibers made of a single polymer with a wide variety of functionalities, e.g., fluorescent detection fibers with embedded quantum dots, antibacterial filters and textiles with silver particles, and tissue engineering scaffolds with controlled drug-release particles. As other examples, catalyst immobilization, for chemical transformations and waste treatment among others, is one possible use because nonwoven composites would have active areas similar to those of nanoparticle suspensions. Embedding of $TiO_2$ particles can confer self-cleaning properties to fibers in the presence of UV light.

The fabrication capacity of this shear nanospinning method scales with the volume of the shearing device. The 6-ml benchtop setup employed in the above Example was able to produce nanofibers at a rate of ~0.1 g/min, and its volume production could be straightforwardly scaled up several thousand times by, for example, using available centrifuge equipment. Production rates of over 1.0 g/min have recently been achieved by using a scaled benchtop apparatus that included a larger diameter rotor (similar to the component 108 of FIG. 1) and a cylindrical beaker (similar to the component 104 of FIG. 1).

The method described herein can process a variety of polymers, and its scalability is one of its best advantages in nanofiber production. The method allows for the spinning of nanofibers from solution at room temperature which is highly desired in the processing of functional polymers, including conductive polymers for flexible electronics. Volume production of such fibers may provide concurrently economical electrical functionality and structural support, and would allow embedding in clothes and other textiles, including disposable garments. Mild processing conditions would benefit numerous other applications, including generation of biocomposite fibers containing active enzymes or even whole live cells.

To summarize the above-described Examples, a scalable method for nanofiber formation from solution based on shear flow has been presented. The fibers had diameters of 200 nm-2 μm, similar to electrospun fiber, and can be created from a wide variety of polymers. It was shown that polymer chain entanglement in solution may be necessary for the production of the fibers, while the smallest diameter size is possibly limited by fundamental phase-separation processes. Scaling up the process would lead to economic routes to polymer nanofibers and polymer-particle composites.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for fabricating polymer nanofibers, the method comprising:

introducing a polymer solution into a dispersion medium to form a dispersion, wherein the polymer solution comprises a polymer dissolved in a polymer solvent at an appropriate concentration, the dispersion medium comprises an appropriate anti-solvent for the polymer at an appropriate concentration such that the polymer solvent is miscible with the dispersion medium, and the dispersion comprises a plurality of polymer solution-inclusive droplets dispersed in the dispersion medium; and shearing the dispersion medium, wherein the droplets elongate and stiffen as the polymer solvent diffuses out from the droplets into the dispersion medium and the anti-solvent enters the elongated droplets by diffusion and precipitates the polymer, to form a plurality of polymer nanofibers having an aspect ratio of 100 or greater and an average diameter of 1 μm or less insoluble in the dispersion medium.

2. The method of claim 1, wherein the polymer nanofibers have an average diameter ranging from 100 nm to 1 μm.

3. The method of claim 1, wherein the polymer nanofibers have an aspect ratio of 10,000 or greater.

4. The method of claim 1, wherein the polymer solution is introduced into the dispersion medium in the form of preformed droplets as an emulsion.

5. The method of claim 1, wherein the polymer nanofibers are solid, hollow, or porous.

6. The method of claim 1, comprising introducing an additive to the dispersion medium wherein the polymer nanofibers are composite structures comprising the polymer and nanoparticles retained by the polymer, and wherein introducing occurs at a time selected from the group consisting of: before introducing the polymer solution into the dispersion medium, while introducing the polymer solution into the dispersion medium, after introducing the polymer solution into the dispersion medium, and combinations of two or more of the foregoing.

7. The method of claim 6, wherein the additive is selected from the group consisting of nanoparticles, quantum dots, ceramics, metals, metal alloys, metal oxides, metalloids, metalloid oxides, magnetic materials, graphite, carbon black, carbon nanotubes, colorants, odorants, deodorants, plasticizers, lubricants, surfactants, crosslinking agents, therapeutically active materials, biological materials, catalytic materials, enzymatic materials, and combinations of two or more of the foregoing.

8. The method of claim 1, wherein the polymer of the polymer nanofibers has a molecular weight of 20,000 Da or greater.

9. The method of claim 1, wherein the polymer is a combination of two or more different polymers.

10. The method of claim 1, wherein the polymer solvent includes a combination of two or more different polymer solvents.

11. The method of claim 1, wherein the dispersion medium includes a combination of two or more different antisolvents.

12. The method of claim 1, wherein the dispersion medium has a viscosity of 1 cP or greater.

13. The method of claim 1, wherein the dispersion medium has a viscosity ranging from 1 cP to 1500 cP.

14. The method of claim 1, wherein the ratio of viscosity of the polymer solution to viscosity of the dispersion medium ranges from 0.1 to 100.

15. The method of claim 1, wherein the dispersion is contained in a volume defined by an inner boundary and an outer boundary surrounding the inner boundary and spaced from the inner boundary by a gap, and shearing comprises moving at least one of the inner boundary and the outer boundary relative to the other.

16. The method of claim 15, wherein the gap is a radial gap, and further comprising oscillating the inner boundary along an axial direction while shearing.

17. The method of claim 15, wherein introducing the polymer solution is selected from the group consisting of flowing the polymer solution from a dispensing device separate from the inner boundary and the outer boundary, and flowing the polymer solution through one or more apertures of the inner boundary.

18. The method of claim 15, comprising controlling a shear stress applied to the dispersion medium while shearing by controlling a parameter selected from the group consisting of a viscosity of the dispersion medium, a velocity at which the inner boundary or the outer boundary is moved relative to the other, the magnitude of the gap, and combinations of two or more of the foregoing.

19. The method of claim 1, comprising controlling a shear stress applied to the dispersion medium while shearing by controlling a parameter selected from the group consisting of a viscosity of the dispersion medium, a shear rate at which the dispersion medium is sheared, and both the viscosity and the shear rate.

20. The method of claim 1, comprising controlling an average diameter of the as-formed nanofibers by controlling a shear stress applied to the dispersion medium while shearing.

21. The method of claim 1, comprising applying an electrical field to the dispersion medium while shearing.

22. The method of claim 1, wherein shearing the dispersion medium comprises applying a shear stress ranging from about 10 Pa to about 1000 Pa.

23. The method of claim 1, wherein shearing the dispersion medium comprises applying a shear stress ranging from about 30 Pa to about 100 Pa.

24. The method of claim 1, wherein shearing occurs under room temperature conditions.

25. The method of claim 1, comprising separating the nanofibers from the dispersion medium.

26. The method of claim 1, wherein the polymer nanofiber has an average diameter ranging from 200 nm to 500 nm.

27. The method of claim 1, wherein the polymer has a molecular weight of 20,000 to 700,000 Da.

28. The method of claim 1, wherein the appropriate concentration for the polymer is a weight/weight % concentration of greater than 4% and less than 30%.

29. The method of claim 28, wherein the appropriate concentration for the polymer is a weight/weight % concentration of greater than 10% and less than 20%.

30. The method of claim 1, wherein the appropriate antisolvent is ethanol, isopropanol, glycerol, methanol, water, or a combination thereof.

31. The method of claim 30, wherein the appropriate antisolvent is an ethanol glycerol mixture.

32. The method of claim 31, wherein the appropriate antisolvent is an ethanol glycerol mixture and the ethanol concentration ranges from 20% to 63%.

33. The method of claim 30, wherein the appropriate antisolvent is a water glycerol mixture.

34. The method of claim 1, wherein the polymer is a polyolefin, a polystyrene, a cellulose, a cellulose acetate, a polylactic acid (PLA), a polyacrylonitrile, a polyvinylidene difluoride, a poly(vinyl chloride), a polytetrafluoroethylene, a poly(α-methylstyrene), a poly(acrylic acid), a poly(isobutylene), a poly(acrylonitrile), a poly(methacrylic acid), a poly (methyl methacrylate), a poly(1-pentene), a poly(1,3-butadiene), a poly(vinyl acetate), a poly(2-vinyl pyridine), a 1,4-polyisoprene, a 3,4-polychloroprene, a poly(ethylene oxide), a polyformaldehyde, a polyacetaldehyde, a poly(3-propionate), a poly(10-decanoate), a poly(ethylene terephthalate), a polycaprolactam, a poly(11-undecanoamide), a poly(hexamethylene sebacamide), a poly(m-phenylene terephthalate), a poly(tetramethylene-m-benzenesulfonamide), a polyacetal, a polyetheretherketone, a polyetherimide, a polyamide, a polyurea, a polyamideimide, a polyarylate, a polybenzimidazole, a polyester, a polycarbonate, a polyurethane, a polyimide, a polyhydrazide, a phenolic resin, a polysilane, a polysiloxane, a polycarbodiimide, a polyimine, an azo polymer, a polysulfide, or a polysulfone.

35. The method of claim 34, wherein the polymer is a cellulose acetate, a polylactic acid (PLA), a poly(methyl methacrylate), or a polystyrene.

36. A method for fabricating polymer nanofibers, the method comprising:

introducing a polymer solution into a dispersion medium to form a dispersion, wherein the polymer solution comprises a polymer dissolved in a polymer solvent at an appropriate concentration, wherein the polymer is at an appropriate concentration to facilitate molecular entanglement, the dispersion medium comprises an appropriate anti-solvent for the polymer at an appropriate concentration such that the polymer solvent is miscible with the dispersion medium, and the dispersion comprises a plurality of polymer solution-inclusive droplets dispersed in the dispersion medium; and shearing the dispersion medium, wherein the droplets elongate and stiffen as the polymer solvent diffuses out from the droplets into the dispersion medium such that the polymer becomes molecularly entangled and forms a plurality of polymer nanofibers having an aspect ratio of 100 or greater and an average diameter of 1 μm or less insoluble in the dispersion medium.

* * * * *